United States Patent [19]

Matsuo

[11] Patent Number: 4,678,120

[45] Date of Patent: Jul. 7, 1987

[54] REFRACTORY FLAME-GUNNING APPARATUS

[75] Inventor: Masataka Matsuo, Kitakyushu, Japan

[73] Assignee: Nippon Steel Corporation, Tokyo, Japan

[21] Appl. No.: 912,176

[22] Filed: Sep. 22, 1986

Related U.S. Application Data

[63] Continuation of Ser. No. 673,173, Nov. 19, 1984, abandoned.

[30] Foreign Application Priority Data

Nov. 22, 1983 [JP] Japan ..... 58-220411

[51] Int. Cl.[4] ..... B05B 12/10

[52] U.S. Cl. ..... 239/75; 239/85; 239/416.1; 239/417.5; 239/571; 431/19; 431/22; 431/346

[58] Field of Search ..... 239/75, 79, 85, 416.1, 239/416.2, 416.5, 416.4, 417.5, 571; 431/19, 22, 346

[56] References Cited

U.S. PATENT DOCUMENTS

| | | | |
|---|---|---|---|
| 1,983,710 | 12/1934 | Schuck, Jr. et al. | 431/22 |
| 2,510,143 | 6/1950 | Sandora et al. | 239/79 |
| 2,691,056 | 10/1954 | Wolff | 431/22 |
| 3,198,434 | 8/1965 | Svrchek et al. | 239/79 |
| 3,684,560 | 8/1972 | Brichard et al. | 239/79 |
| 4,192,460 | 3/1980 | Matsuo | 239/79 |
| 4,251,226 | 2/1981 | Nishikawa | 431/346 |
| 4,317,540 | 3/1982 | Simm et al. | 239/85 |
| 4,361,420 | 11/1982 | Bell | 431/346 |
| 4,363,443 | 12/1982 | Huehne . | |

FOREIGN PATENT DOCUMENTS

| | | |
|---|---|---|
| 1068194 | 11/1959 | Fed. Rep. of Germany . |
| 2066355 | 10/1970 | France . |
| 2471552 | 12/1979 | France . |
| 56-31332 | 7/1981 | Japan . |

*Primary Examiner*—Andres Kashnikow
*Assistant Examiner*—Michael J. Forman
*Attorney, Agent, or Firm*—Wenderoth, Lind & Ponack

[57] ABSTRACT

A refractory flame-gunning apparatus has a feeder, a controller and a flame-gunning burner. The feeder has a refractory-powder feeding section, an imflammable-gas feeding section and a combustion-assisting-gas feeding section. The controller controls the supply of refractory powder, inflammable and combustion-assisting gases. The flame-gunning burner has a plurality of refractory powder and flame ejecting nozzles disposed at its tip. The flame-gunning burner has a gas mixer and a combustion-assisting-gas cutoff valve. The gas mixer has an inflammable-gas passage leading to the inflammable-gas feeding section, a combustion-assisting-gas passage leading to the combustion-assisting-gas feeding section, a gas mixing chamber communicating with the inflammable and combustion-assisting gas passages, and a mixed-gas passage the upstream side of which communicates with the gas mixing chamber and the downstream side of which communicates with the flame ejecting nozzles. The gas mixer is provided for each individual flame nozzle. The combustion-assisting-gas cutoff valve is provided in the gas mixer and is actuated by the gas pressure built up in the mixed-gas passage. When backfire occurs, the pressure in the mixed-gas passage rises to close the combustion-assisting-gas cutoff valve, whereby the backfire is put out instantaneously.

5 Claims, 7 Drawing Figures

REFRACTORY FLAME-GUNNING APPARATUS

This application is a continuation of now abandoned application Ser. No. 673,173, filed Nov. 19, 1984.

BACKGROUND OF THE INVENTION

1. Field of the Invention

This invention relates to a refractory flame-gunning apparatus that is used for the repair of furnace walls, inside walls of molten-metal containers and the like by spraying refractories onto their surface through a gas flame. More particularly, this invention relates to a flame-gunning apparatus that feeds refractory powder into a flame produced by burning a mixture of inflammable and combustion-assisting gases, thereby melting the refractory powder and applying the molten refractory onto the surface to be coated, and also to an apparatus that instantaneously stops any backfire that occurs in the inflammable and combustion-assisting gas supplying system of the refractory flame-gunning apparatus.

2. Description of the Prior Art

This type of flame-gunning apparatus has a flame-gunning burner comprising a plurality of refractory powder projecting nozzles and flame projecting nozzles. The flame-gunning burner shoots refractory powder and flame together onto the wall surface requiring repairs. In this type of refractory flame-gunning apparatus that employs flame, backfire, a phenomenon in which flame runs backward from the flame nozzles into the gas supply passage, can occur. Backfire occurs when the inflammable gas ejected from the flame nozzles burns faster than the rate at which it is ejected. More specifically, backfire occurs, for example, when the gas ejection rate drops as a result of the clogging of the flame nozzles, when the combustion rate rises as a result of an increase in gas temperature, when the gas flow rate or pressure changes, or when the flame nozzles are hit or clogged as a result of the mishandling of the apparatus in transit.

Backfire can damage the inside of the flame-gunning burner, sometimes to such an extent that repairs can no longer be continued or a serious disaster results. When backfire occurs in a conventional apparatus, therefore, the operator stops the supply of the inflammable and combustion-assisting gases by closing the feed valves on the inflammable and combustion-assisting gas feed lines either manually or by remote control. However, it is difficult to stop the gas supply instantaneously by this type of action taken by the operator and, therefore, there is a likelihood that the backfire will lead to a serious disaster. It is of course ideal to thoroughly eliminate the possibility of backfire.

For example, the flame-gunning apparatus proposed in the Japan Examined Utility Model Publication No. 31332 of 1981 is designed to prevent the occurrence of backfire on termination of gunning. Still, such an apparatus can hardly achieve complete prevention of backfire since backfire results from various causes as described previously, even while gunning is being effected.

A safety device for a refractory flame-gunning apparatus disclosed in the U.S. Pat. No. 3,684,560 closes a valve in the oxygen feed pipe when a gas pressure irregularity in the lance is detected by a manometer. However, the feed valve cannot be closed the moment backfire occurs since the design is such that the valve does not close until a control device operates upon receiving a signal from the manometer. Besides, the reliability of the safety device is low since it does not function if any of the manometer, control device and feed valve breaks.

As a consequence, there has been a strong demand for the development of an apparatus that can instantaneously and surely stop a backfire.

SUMMARY OF THE INVENTION

The object of this invention is to provide a refractory flame-gunning apparatus that is capable of stopping a backfire instantaneously and with certainty.

A refractory flame-gunning apparatus according to this invention comprises a feeder, a controller and a flame-gunning burner. The feeder comprises a refractory powder feeding section, an inflammable gas feeding section and a combustion-assisting gas feeding section. The controller controls the supply of a refractory powder, an inflammable gas and a combustion-assisting gas. The flame-gunning burner has a plurality of refractory-powder and flame ejecting nozzles disposed at the tip thereof.

The flame-gunning burner is equipped with a gas mixer and a combustion-assisting gas cutoff valve. The gas mixer comprises an inflammable gas passage communicating with said inflammable gas feeding section, a combustion-assisting gas passage communicating with said combustion-assisting gas feeding section, a gas mixing chamber communicating with both the inflammable and combustion-assisting gas passages, and a mixed-gas passage the upstream side of which communicates with the gas mixing chamber and the downstream side of which communicates with said flame nozzles. The gas mixer is provided for each individual flame nozzle. The combustion-assisting gas cutoff valve is provided in the gas mixer and is actuated by the pressure of the gas passing through the mixed-gas passage.

When a backfire occurs in the apparatus just described, the pressure in the mixed-gas passage rises to close the combustion-assisting gas cutoff valve and thereby put out the fire.

The controller of the apparatus according to this invention is equipped with an inflammable gas passage communicating with the inflammable gas feeding section, a combustion-assisting gas passage communicating with the combustion-assisting gas feeding section, a first inert gas passage connecting the inflammable gas passage to an inert-gas feeding section, and a second inert gas passage connecting the combustion-assisting gas passage to the inert-gas feeding section. The controller is also equipped with a control unit including an inflammable gas valve that is provided between the junction where the inflammable gas passage meets the first inert-gas passage and the inflammable gas feeding section, a combustion-assisting gas valve that is provided between the junction where the combustion-assisting gas passage meets the second inert-gas passage and the combustion-assisting gas feeding section, a first inert-gas valve provided in the first inert-gas passage, a second inert-gas valve provided in the second inert-gas passage, and a temperature sensor. The temperature sensor is positioned in said mixed-gas passage. On receiving signals from the temperature sensor, the control unit outputs opening and closing signals to the inflammable gas, combustion-assisting gas, first inert gas and second inert gas valves.

When a backfire occurs in the apparatus described above during or on terminating flame gunning, the temperature in the mixed-gas passage rises. The temperature sensor senses the temperature increase and outputs a corresponding temperature signal to the controller. The controller opens and closes said gas valves in accordance with the temperature signals received. That is, the inflammable gas valve is closed, the first inert-gas valve is opened, the combustion-assisting gas valve is closed and the second inert-gas valve is opened, as a result of which the backfire is put out instantaneously. Provision may also be made so that the second inert-gas valve is opened by said signal while leaving the combustion-assisting gas valve unclosed. Then, a mixture of the combustion-assisting and inert gases is supplied to the mixed-gas passage.

Backfire in this apparatus is put out instantaneously and surely because the inflammable-gas cutoff valve is actuated directly by the pressure in the mixed-gas passage.

If provision is made to sense the temperature and pressure and automatically cut off the supply of the inflammable and combustion-assisting gases, backfire is put out instantaneously with greater certainty.

DESCRIPTION OF THE PREFERRED EMBODIMENT

Figure 1:
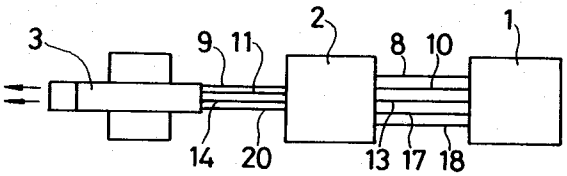
FIG. 1 is an overall block diagram of a refractory flame-gunning apparatus.

Referring now to the drawings, a preferred embodiment of this invention will be described.

FIG. 1 schematically shows the overall makeup of a flame-gunning apparatus which comprises a feeder 1, controller 2 and flame-gunning burner 3.

FEEDER

Figure 2:
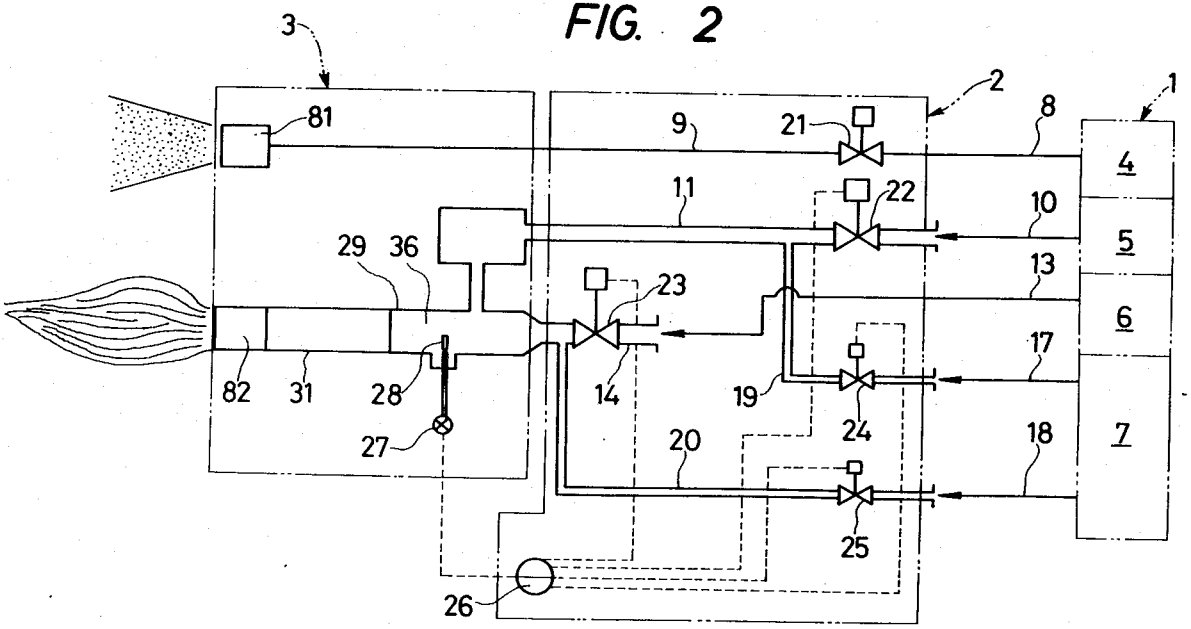
FIG. 2 is a schematic illustration of a preferred embodiment of this invention.

As shown in FIG. 2, the feeder 1 comprises a refractory-powder feeding section 4, inflammable-gas (propane gas) feeding section 5, combustion-assisting-gas (oxygen) feeding section 6, and an inert-gas feeding section 7. These gas feeding sections are in actuality pressurized containers holding said gases.

The refractory-powder feeding section 4 leads to a plurality of refractory-powder ejecting nozzles 81 in the flame-gunning burner 3 to be described later via refractory-powder feed pipes 8 and 9.

The inflammable-gas feeding section 5 leads to a gas mixer 29 in the flame-gunning burner 3 via an inflammable-gas feed pipe 10, an inflammable-gas feed passage 11 in the controller 2, and so on.

The combustion-assisting-gas feeding section 6 leads to the gas mixer 29 via a combustion-assisting gas feed pipe 13, combustion-assisting feed passage 14 in the controller 2, and so on.

The flame-gunning burner 3 has a plurality of flame nozzles 82. To each nozzle 82 is connected a passage for feeding a combination of gases from an inflammable-gas feed pipe 10 and inflammable-gas feed passage 11 and a passage for feeding a combustion-assisting-gas from feed pipe 13 and a combustion-assisting-gas feed passage 14. The passages are connected, independent of each other, to a gas mixer 29 that is provided for each flame nozzle 82.

CONTROLLER

The inert-gas feeding section 7 leads to the inlet of inert-gas feed passages 19 and 20 in the controller 2 via inert-gas feed pipes 17 and 18, respectively. The outlet of the inert-gas feed passage 19 leads to a midway point in the inflammable-gas feed passage 11. The outlet of the inert-gas feed passage 20 leads to a midway point in the combustion-assisting-gas feed passage 14.

A refractory-powder valve 21 is provided between the refractory-powder feed pipes 8 and 9. An inflammable-gas valve 22 is provided in the inflammable-gas feed passage 11, upstream of the point where the inert-gas feed passage 19 is connected. A combustion-assisting-gas valve 23 is provided in the combustion-assisting gas feed passage 14, upstream of the point where the inert-gas feed passage 20 is connected. Inert-gas valves 24 and 25 are provided midway in the inert-gas feed passages 19 and 20. The gas valves 22 to 25 are, for example, solenoid valves which are electrically connected to the control unit 26.

A temperature sensor 28 is connected to the control unit 26 through a transmitter 27. The tip or the temperature-sensing end of the temperature sensor 28 projects into a mixed-gas passage 36 of the gas mixer 29.

FLAME-GUNNING BURNER

Figure 3:
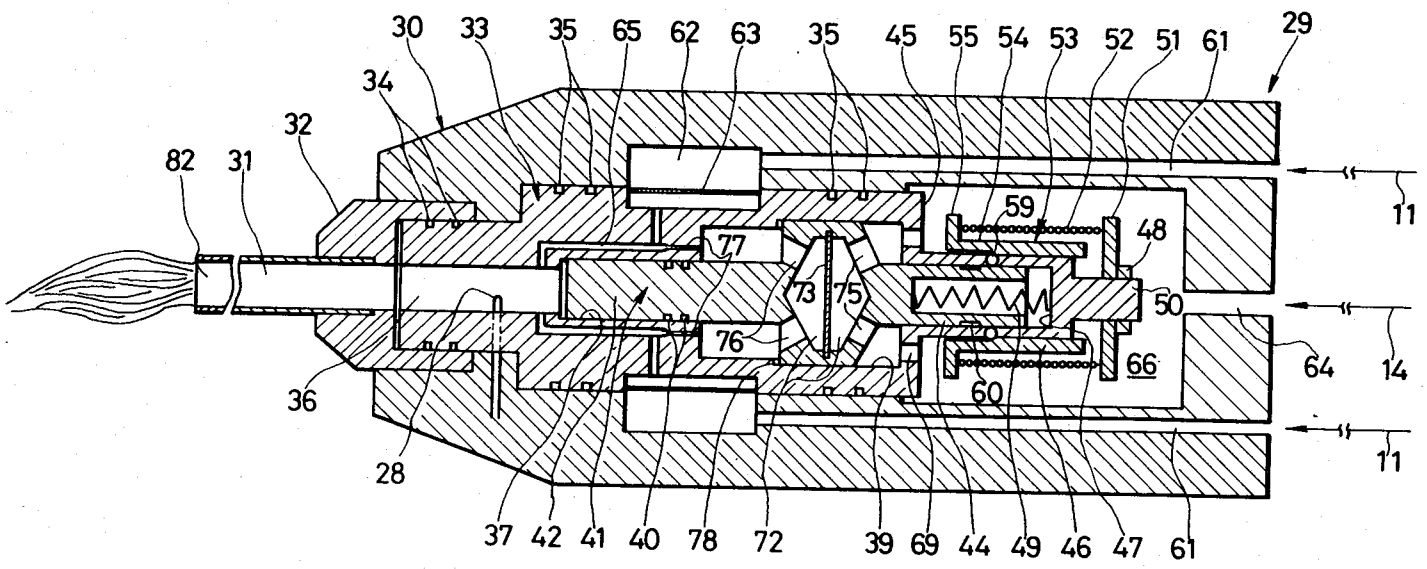
FIG. 3 is a cross-sectional view showing a part of a flame-gunning burner used in the preferred embodiment.

In the gas mixer 29, the base end of a burner pipe 31 is fastened in the tip of a substantially cylindrical housing 30 by means of a burner-pipe coupling 32 as shown in FIG. 3. A mixing pipe 33 is fastened in the larger-diameter rear end of the burner-pipe coupling 30 (remote from the burner pipe 31) and the forward end (close to the tip) of the housing 30 through O-rings 34 and 35. The mixing pipe 33 has a mixed-gas passage 36 in the front portion, a cylinder 37 in the middle, and an intermediate combustion-assisting-gas chamber in the rear portion thereof.

A piston 42 connected to an actuating rod 41 is axially slidably fitted in the cylinder 37 through O-rings 40. The actuating rod 41 behind the piston 42 has a combustion-assisting-gas filter chamber 72 that is axially slidably fitted in an intermediate combustion-assisting-gas chamber 39. A cylindrical spring holder 44 projects rearward from the combustion-assisting-gas filter chamber 72. An annular end-wall 45 is provided on the mixing pipe 33 in such a manner as to wall up the rear end of the intermediate combustion-assisting-gas chamber 39. The inner surface of a cylindrical guide 46 projecting rearward from the end-wall 45 is axially slidably fitted over the outer surface of said spring holder 44. The end-wall 45 serves as the valve seat of a cutoff valve 53 as will be described later. The rear end of the cylindrical guide 46 is closed by an end-wall 47 that compresses a coil spring 49 contained in the spring holder 44 in the actuating rod 41. A support 50 projects from the center of the end-wall 47 in the direction opposite to the spring 49. An annular spring shoe 51 is fastened to the rear end of the support 50 by a nut 48. A compressed valve spring 52 is inserted between the spring shoe 51 and a flange 55 at the forward end of a sleeve 54. The sleeve 54 is axially slidably fitted over the outer surface of said guide 46. The flange 55 serves also as a valve disc acting against said end-wall 45. That is, the end-wall 45, valve spring 52 and sleeve 54 make up a cutoff valve 53.

Figure 4:
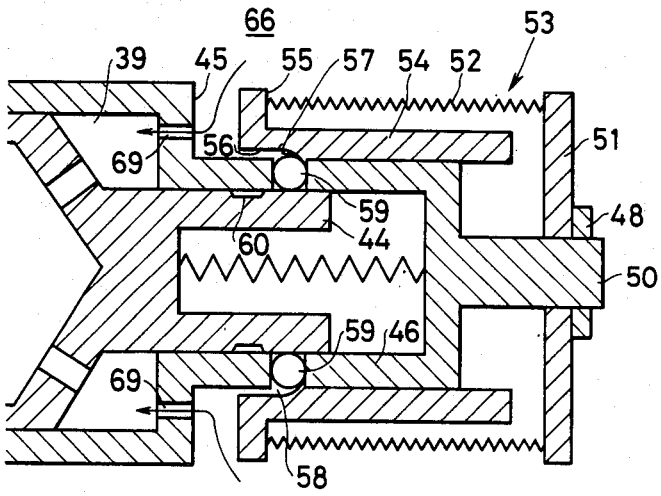
FIG. 4 illustrates the operation (in the open state) of a cutoff valve in the flame-gunning burner of FIG. 3.
Figure 5:
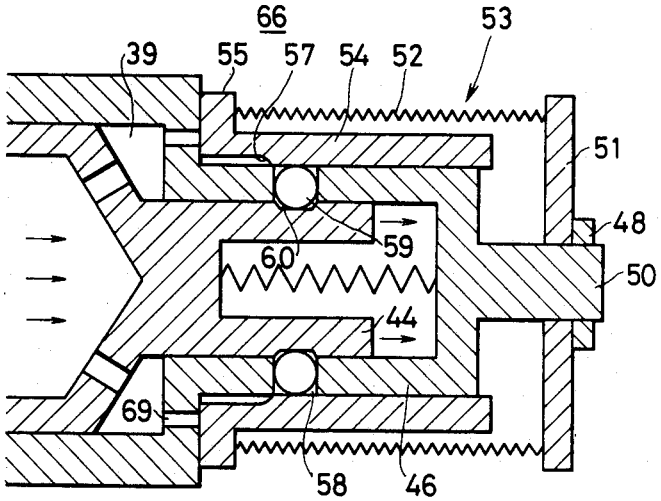
FIG. 5 illustrates the operation (in the closed state) of the same cutoff valve shown in FIG. 4.

As shown in a partial enlarged view in FIG. 4, the front portion of the sleeve 54 has formed therein a bore 56 that has a slightly larger diameter than the rest. FIG. 4 shows a state in which flame-gunning is being conducted normally, in which the inner surface of the rear end of the bore 57 constitutes an inclined cam surface. A plurality of balls 59 are annularly disposed in an opening provided in said guide 46. An annular groove 60 is provided in the outer surface of the spring holder 44 of the actuating rod 41. In a normal state, the groove 60 is positioned somewhat ahead of the balls 59. In this state, part of the balls 59 slightly protrudes from the groove 60, with the projecting portion contacting said inclined cam surface 57. As will be understood from the above description, the balls 59 keep the sleeve 54 from moving forward under the influence of the elastic force exerted by the spring 52. Under a normal condition, the front end of the flange 55 of the sleeve 54 serving as the valve disc is away from the end-wall 45 that serves as the valve seat. FIG. 5 shows a state in which the cutoff valve 53 is closed.

Next, the structure of the inflammable and combustion-assisting gas passages will be described. The inflammable-gas feed passage 11 and combustion-assisting-gas feed passage 14 are connected to passages 61 and 64 shown in FIG. 3. A plurality of inflammable-gas passages 61 extend through the housing 31 to an inflammable-gas filter chamber 62 in the front. The inflammable-gas filter chamber 62 is composed of annular grooves formed in the inner surface of the housing 30 and the outer surface of the mixing pipe 33. An annular inflammable-gas filter 63 is fitted in the inflammable-gas filter chamber 62. The filter 63 radially divides the inflammable-gas filter chamber 62 into inner and outer spaces. The inflammable-gas passages 61 lead to the space on the outer side of the filter 62. The mixing pipe 33 has a plurality of mixed-gas chambers 65 leading to the space on the inner side of the filter 62. The outlet of the mixed-gas chambers 65 leads to said mixed-gas passage 36.

The combustion-assisting-gas passage 64 is provided in the rear wall of the housing 31 and opens into a combustion-assisting-gas chamber 66 in the rear of the housing 30. The combustion-assisting-gas chamber 66 is a space accommodating said sleeve 54 and valve spring 52. A plurality of connecting ports 69 to connect the combustion-assisting-gas chamber 66 to the intermediate combustion-assisting-gas chamber 39 are provided in the end wall 45 of the mixing pipe. A combustion-assisting-gas filter 73 to divide the combustion-assisting-gas filter chamber 72 into front and rear spaces is provided therein. A plurality of connecting ports 75 and 76 are provided to the rear and front spaces of the combustion-assisting-gas filter chamber 72. The rear portions of the intermediate combustion-assisting-gas chamber 39 and the coubustion-assisting-gas filter chamber 72 communicate with each other through the connecting ports 75. The front portions of the intermediate combustion-assisting-gas chamber 39 and the combustion-assisting-gas filter chamber 72 communicate with each other through the connecting ports 76. The front end of the intermediate combustion-assisting-gas chamber 39 communicates with the mixed-gas chamber 65 through a combustion-assisting gas passage 77 in the mixing pipe 33. In the state illustrated, the periphery of the front end of the combustion-assisting-gas filter chamber 72 is kept in contact with an annular gasket 78 attached to an annular step midway on the inner surface of the intermediate combustion-assisting-gas chamber 39.

Figure 6:
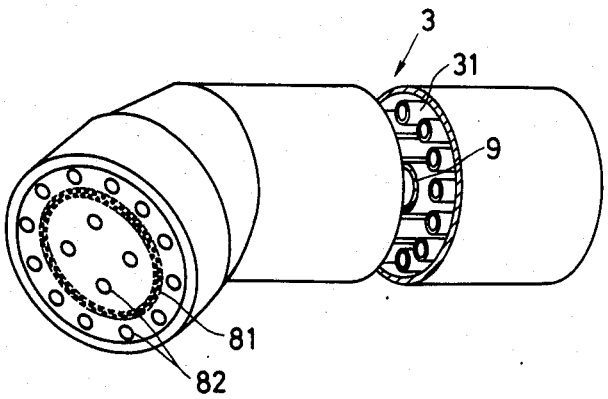
FIG. 6 is a perspective view showing the tip of the flame-gunning burner.

A plurality of refractory-powder ejecting nozzles 81 and flame nozzles 82 are disposed at the tip of the flame-gunning burner 3 as shown in FIG. 6. The refractory-powder ejecting nozzles 81 are connected to the refractory-powder feed pipe 9. The flame nozzles 82 are individually connected to the gas mixer 29 via the burner pipe 31.

OPERATION OF THE APPARATUS

When normal flame-gunning is performed, inflammable and combustion-assisting gases are supplied from the feeder 1 through the controller 2 shown in FIG. 1 to the inflammable-gas passage 61 and combustion-assisting-gas passage 64 shown in FIG. 3. The combustion-assisting gas flows from the passage 64 through the combustion-assisting-gas chamber 66 to the rear portion of the intermediate combustion-assisting-gas chamber 39, and then further to the mixing chamber 65 by way of the combustion-assisting-gas filter chamber 72, the front portion of the intermediate combustion-assisting-gas chamber 39 and passage 77. The inflammable gas flows from the inflammable-gas passage 61 through the inflammable-gas filter chamber 62 into the mixing chamber 65. The inflammable and combustion-assisting gases are mixed together in the mixing chamber 65. After passing through the mixed-gas passage 36, the mixed gas reaches the flame nozzles 82 at the tip of the burner pipe 31 where the mixed gas is set on fire, with the resulting flame bursting forth therefrom.

When backfire occurs, that is, when the flame passes backward from the flame nozzles 82 toward the mixed-gas passage 36, the individual parts work as described in the following. When backfire occurs, high pressure works on the front end of the piston 42 from the side of the mixed-gas passage 36, whereby the whole of the actuating rod 41 moves backward to bring the groove 60 to the position where the balls 59 are disposed. The sleeve 54 urged by the spring 52 pushes the balls 59 down into the groove 60 over the inclined cam surface 57 as shown in FIG. 5. With the stopper provided by the balls 59 thus removed, the sleeve 54 moves forward, as a result of which the connecting ports 69 are closed by the front end of the flange 55 serving as the valve seat. Consequently, the supply of the combustion-assisting gas from the combustion-assisting-gas chamber 66 to the intermediate combustion-assisting-gas chamber 39 is stopped, thereby putting out the backfire.

Even if the flame runs backward deeper before the backfire is put out, the flame does not reach the combustion-assisting gas chamber 66 before the cutoff valve 53 is closed since the propagation rate of the flame is drastically reduced when passing through the combustion-assisting-gas filter 73 shown in FIG. 3.

Figure 7:
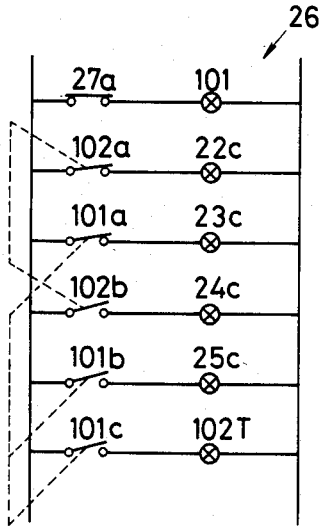
FIG. 7 is a sequence circuit diagram of a controller used in the flame-gunning apparatus of this invention.

When the temperature in the mixed-gas passage 36 rises as a result of backfire, the temperature sensor 28 shown in FIG. 2 senses the change and sends a corresponding signal to the control unit 26. Then, a contact **27*a* in a sequence circuit shown in FIG. 7 is closed to energize a coil 101 of an electromagnetic relay. With the coil 101 energized, a contact 101*a* is opened while contacts 101*b* and 101*c* are closed. Consequently, a coil 23*c* is de-energized to close the combustion-assisting-gas valve 23 while a coil 25***c* is energized to open the inert-gas valve 25. A timer 102T works simultaneously. After a predetermined time, a contact 102*a* opens to de-energize a coil 22*c*, thereby closing the inflammable-gas valve 22. At the same time, a contact 102*b* closes to energize a coil 24*c*, thereby opening the inert-gas valve 24. As a consequence, the supply of the inflammable and combustion-assisting gases to the gas mixer 29 is stopped. Then, the inert gas is supplied from the inert-gas passages 19 and 20 to the gas mixer 29 through the combustion-assisting-gas passages 61 and 64 of the flame-gunning burner 3. The backfire is instantaneously put out by this action as well. The inert-gas feed valves 24 and 25 are closed while normal flame gunning is being conducted.

The refractory-powder valve 21 is opened and closed by a manually operated switch. However, provision may also be made for automatic operation, as is done with the inflammable-gas valve 22 and other valves.

As described above, the cutoff valve 53 in the combustion-assisting-gas feed line is closed by the actuating rod 41 that is operated by the high pressure built up when backfire occurs, so that the backfire is put out instantaneously with certainty.

When the occurrence of backfire is sensed by the temperature sensor having the temperature sensing tip 28, the valves 22 and 23 in the inflammable-gas feed line 11 and combustion-assisting-gas feed line 14 are closed. This provision also permits instantaneous extinguishment of the backfire. As shown in the illustrated preferred embodiment, provision to feed inert gas upon occurrence of backfire permits the backfire to be put out instantaneously with greater certainty.

In the preferred embodiment described hereabove, propagation of backfire is prevented by actuating the cutoff valve through the use of an increase in pressure and the gas feed valves through the detection of a temperature change. However, the same goal may also be achieved by the use of the cutoff valve alone. The object of this invention may also be accomplished almost satisfactorily, at a lower cost, by supplying an inert gas containing some oxygen (such as air) instead of the oxygen-free inert gas that is used in the preferred embodiment described herein.

What is claimed is:

1. A refractory flame-gunning apparatus which comprises:

a feeder comprising a refractory powder feeding section, an inflammable gas feeding section, a combustion-assisting gas feeding section, and an inert gas feeding section;

a controller for controlling the supply of refractory powder and the supply of inflammable gas, combustion-assisting gas and inert gas, said controller having an inflammable gas pipe means extending from said inflammable gas feeding section, a combustion-assisting gas pipe means extending from said combustion-assisting gas feeding section, a first inert gas pipe means extending from said inert gas feeding section and connected to said inflammable gas pipe means, a second inert gas pipe means extending from said inert gas feeding section and connected to said combustion-assisting gas pipe means, an inflammable gas valve in said inflammable gas pipe means between the point where said inflammable gas and first inert gas pipe means meet and said inflammable gas feeding section, a combustion-assisting gas valve in said combustion-assisting gas pipe means between the point where said combustion-assisting gas and second inert gas pipe means meet and said combustion-assisting gas feeding section, a first inert gas valve in said first inert gas pipe means, a second inert gas valve in said second inert gas pipe means; and a control unit including a temperature sensor for detecting a temperature due to backfiring, the control unit including means for outputting opening and closing signals to said inflammable gas valve, said combustion-assisting gas valve and said first and second inert gas valves on the basis of signals emitted by said temperature sensor; and a flame-gunning burner having a plurality of refractory powder and flame ejecting nozzles disposed at the tip thereof, a gas mixer having an inflammable gas passage to which said inflammable pipe means is connected, a combustion-assisting gas passage to which said combustion-assisting gas pipe means is connected, said burner having a gas mixing chamber therein to which said inflammable and combustion-assisting gas passages are connected, and a mixed gas passage extending out of said gas mixing chamber to said flame ejecting nozzles, and a combustion-assisting gas cutoff valve in said combustion-assisting gas passage normally urged toward the closed position and held out of said closed position and having means exposed to said mixed gas passage for releasing the holding of said cutoff valve to quickly close said combustion-assisting gas passage in response to a build-up of pressure in said mixed gas passage due to backfiring, said temperature sensor being positioned in said mixed gas passage, and said outputting means in said control unit outputting signals for closing said combustion-assisting gas valve and opening said second inert gas valve when a temperature indicating backfiring is sensed, and for subsequently closing said inflammable gas valve and opening said first inert gas valve.

2. An apparatus as claimed in claim 1 in which the gas mixer comprises a housing having said inflammable gas and combustion-assisting gas passages therein, a mixing pipe mounted in said housing within which said mixed gas passage is located, a cylinder extending out of said mixing pipe, and a piston means axially slidably fitted in said cylinder and operatively connected to said cutoff valve to close said cutoff valve when said piston means moves rearwardly in response to build-up of pressure in said mixing pipe.

3. An apparatus as claimed in claim 2 in which said combustion-assisting gas passage has a combustion-assisting gas chamber therein, and further comprising an actuating rod slidable in said chamber and to which said piston means is connected, and means defining a connecting passage means for the combustion-assisting gas in said combustion-assisting gas chamber, said cutoff valve having a valve member movable to open and close said connecting passage means in response to movement of said actuating rod.

4. An apparatus as claimed in claim 2 in which said gas mixer further has an inflammable gas filter chamber in said inflammable gas passage with a gas filter therein, and a combustion-assisting gas filter chamber mounted on said actuating rod within said combustion-assisting gas chamber and having a gas filter therein and having openings on opposite sides of said gas filter for directing combustion-assisting gas through said combustion-assisting gas filter chamber.

5. An apparatus as claimed in claim 2 in which said cutoff valve comprises a valve seat in said combustion-assisting gas chamber and having apertures therein, a cylindrical guide projecting away from said mixing pipe into said combustion-assisting gas chamber, a sleeve slidably fitted on said guide for movement toward and away from said valve seat and having a valve body thereon for closing said apertures when said valve body is against said valve seat, said piston having an actuating rod thereon extending into said guide, a first spring between the rear end of said cylindrical guide and said actuating rod for urging said actuating rod forward toward said mixing pipe, a further spring connected between the rear end of said cylindrical guide and said sleeve for urging said sleeve toward said valve seat, and locking means normally blocking movement of said sleeve toward said valve seat and engageable by said actuating rod during rearward movement thereof to release said sleeve.

* * * * *